United States Patent [19]

Yoneyama

[11] Patent Number: 4,764,149

[45] Date of Patent: Aug. 16, 1988

[54] SPRING DRIVEN TWO-WHEEL TOY VEHICLE

[75] Inventor: Hitoshi Yoneyama, Saitama, Japan

[73] Assignee: Takara Co., Ltd., Tokyo, Japan

[21] Appl. No.: 97,663

[22] Filed: Sep. 15, 1987

Related U.S. Application Data

[63] Continuation-in-part of Ser. No. 921,317, Oct. 21, 1986, abandoned.

[30] Foreign Application Priority Data

Oct. 28, 1985 [JP] Japan ..... 60-241012[U]
Oct. 28, 1985 [JP] Japan ..... 60-165433
Oct. 28, 1985 [JP] Japan ..... 60-165434

[51] Int. Cl.[4] ..... A63H 17/21; A63H 29/24

[52] U.S. Cl. ..... 446/440; 446/464; 185/39; 185/DIG. 1

[58] Field of Search ..... 446/464, 462, 440, 457, 446/463, 448; 185/39, 38, 37, DIG. 1

[56] References Cited

U.S. PATENT DOCUMENTS

| | | | |
|---|---|---|---|
| 2,577,702 | 6/1947 | De Swart | 446/121 X |
| 4,135,329 | 1/1979 | Kennedy | 185/39 X |
| 4,201,011 | 5/1980 | Cook | 446/462 X |
| 4,332,104 | 6/1982 | Ribas et al. | 446/457 |
| 4,463,515 | 8/1984 | Barlow et al. | 446/440 X |
| 4,463,831 | 8/1984 | Wakase | 446/464 X |
| 4,563,164 | 1/1986 | Tao | 446/463 X |

*Primary Examiner*—Mickey Yu
*Attorney, Agent, or Firm*—Price, Gess & Ubell

[57] ABSTRACT

A spring driven two-wheel toy vehicle in which the weights of the spring drive unit and the transmission gears are distributed such that the toy is laterally well-balanced. In order to simplify assembly, a frame is provided with integrally formed shafts to which various transmission gears are affixed and is integrally provided with steering shaft support bearings.

5 Claims, 3 Drawing Sheets

FIG. 1
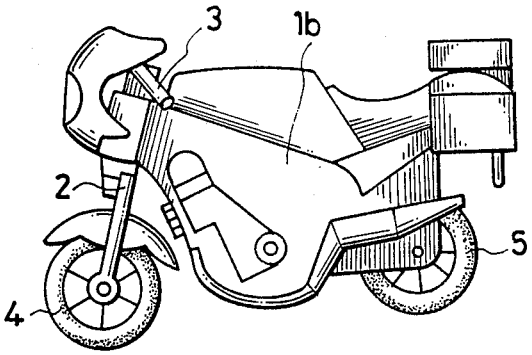
FIG. 2
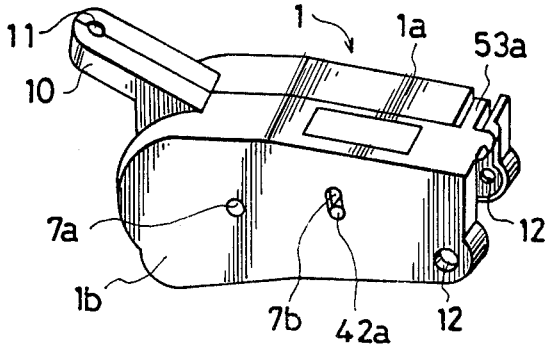
FIG. 3
FIG. 12
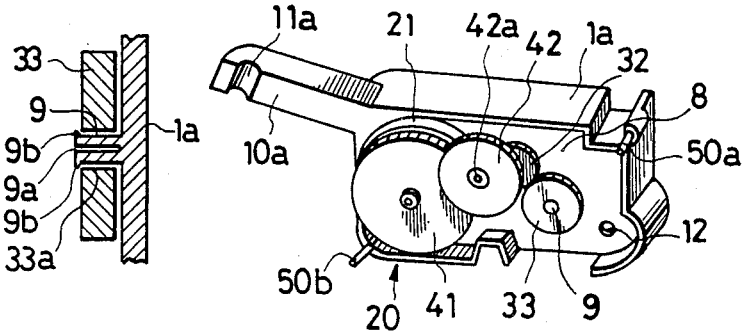

SPRING DRIVEN TWO-WHEEL TOY VEHICLE

BACKGROUND OF THE INVENTION

This application is a continuation-in-part of application Ser. No. 921,317, filed Oct. 21, 1986, now abandoned. The present invention relates to a spring driven two-wheel toy vehicle of improved weight balance and of a construction that simplifies assembly.

In a conventional two-wheel toy vehicle, as shown in FIG. 11, a frame 1 having a front wheel 4 and a rear wheel 5 is provided with a windup spring drive unit 20 disposed to one side wall 8 thereof, and the drive force of a windup spring is transmitted to a gear 5*a* mounted on a rear axle via a series of gears 4*a*, 4*b* and 4*c* rotatably mounted to the one side wall 8.

However, in this case, there are problems associated with the mounting of the windup spring drive unit and transmission mechanism. For example, since the rotary shafts of the series of gears are rotatably supported by bearing holes formed in the one side wall, the rotary shafts of the gears tend to fall out of the bearing holes in the side wall when assembling the gears onto the frame and thus it is difficult to fix the rotary shafts of the gears to the frame. Hence, the work efficiency is worse and the manufacturing cost of such a conventional toy is high.

Further, since the windup spring drive unit for a conventional four-wheel toy vehicle is utilized in the two-wheel toy vehicle, as shown in FIG. 11, the windup spring drive unit is mounted to the one side wall and the driving force of the windup spring is transmitted to the rear wheel through the gear secured to the one side of the rear axle. Therefore, the weight of the two-wheel toy vehicle is unbalanced to the one side in which the windup spring drive unit is mounted to the one side wall.

Furthermore, in a conventional two-wheel toy vehicle, a windup spring drive unit having a windup spring, a series of transmitting gears and a rear drive axle are mounted to a frame, and the frame is provided with a bearing for supporting a steering shaft which connects a front wheel to a handle. In the prior art, when the frame is composed of a pair of left and right half members, the two half members are connected by screws in general. In this embodiment, when the steering bearing is made separate from the frame, the number of the components of the two-wheel toy vehicle increases and its structure is complicated. Accordingly, the steps in assembling the two-wheel toy vehicle increases and the strength of the connecting portions of the components is reduced.

SUMMARY OF THE INVENTION

Accordingly, it is an object of the present invention to provide a windup spring driven two-wheel toy vehicle, free from the aforementioned defects and disadvantages of the prior art, which is capable of simplifying the assembly in order to improve productivity and reduce manufacturing costs and in which the weight of the windup spring drive unit and the transmission gears is distributed such that a more balanced vehicle results.

In accordance with one aspect of the invention, there is provided a two-wheel toy vehicle comprising a frame, a windup spring drive unit having a windup spring and a transmission gear mechanism, and an axle for a drive wheel, in which the driving force of the windup spring is transmitted to the axle via the transmission gear mechanism, the improvement wherein the frame comprises a pair of left and right half cases which are coupled to each other by engaging members formed thereon.

In a preferred embodiment of the invention, some shafts of a series of gears are integrally formed on a frame in advance, and the gears are rotatably fitted on the shafts when assembling the two-wheel toy vehicle.

In another embodiment of the invention, the windup spring drive unit is arranged along the longitudinal plane of the frame and two sets of transmission gears are disposed on either side thereof, interconnecting it with the rear wheel. One transmission gear set serves to transmit windup force from the rear wheel to the windup spring drive unit while the other serves to transmit drive force from the windup spring drive unit back to the rear wheel.

In a further embodiment of the invention, a steering shaft bearing is integrally disposed within the frame or pair of half cases.

Other and further objects, features and advantages of the invention will appear more fully from the following description with reference to the preferred embodiment thereof taken in conjunction with the accompanying drawings, in which:

BRIEF DESCRIPTION OF THE DRAWINGS

FIG. 1 is a left side view of a two-wheel toy vehicle according to the present invention;

FIG. 2 is a perspective view of a frame of the two-wheel toy vehicle of FIG. 1;

FIG. 3 is a perspective view of a right half of the frame of FIG. 2 including a windup spring drive unit therein;

FIG. 12 is a fragmentary longitudinal cross sectional view of a first drive gear of FIG. 3;

DESCRIPTION OF THE PREFERRED EMBODIMENT

Figure 4:
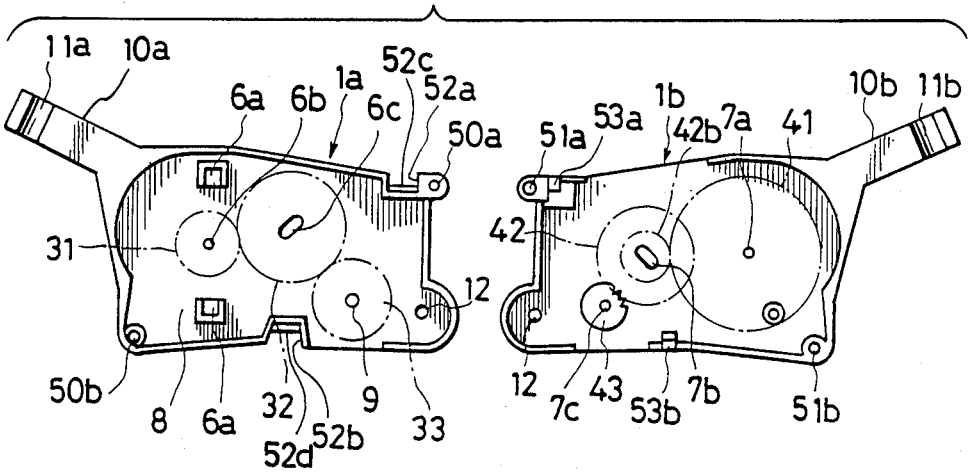
FIG. 4 is an inside view of the halves of the frame of FIG. 2, opened along the longitudinal plane.

Referring now to the drawings, wherein like reference numerals designate similar or corresponding components throughout the different figures, there is shown in FIG. 1 a windup spring driven two-wheel toy vehicle according to the present invention.

Figure 5:
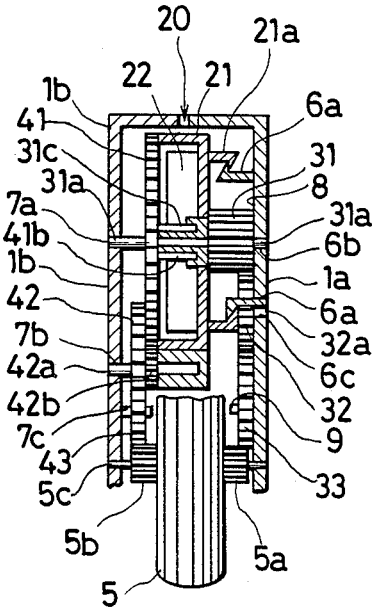
FIG. 5 is an enlarged transverse cross sectional view of the windup spring drive unit contained in the frame, as shown in FIG. 3.
Figure 6:
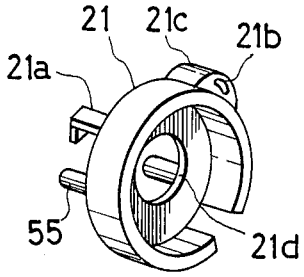
FIG. 6 is a perspective view of a box for containing a windup spring of the windup spring drive unit of FIG. 5.
Figure 10:
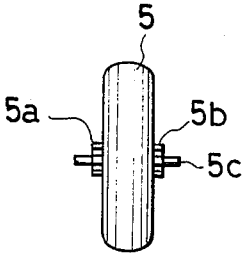
FIG. 10 is a front view of a rear wheel of the two-wheel toy vehicle of FIG. 1.

As shown in FIGS. 1 and 2, the two-wheel toy vehicle comprises a frame 1, a steering shaft 2 inserted in a bearing hole 11 formed in a steering shaft support 10 projecting from the front of the frame 1, a steering handle 3 secured to the top end of the steering shaft 2, a front wheel 4 rotatably mounted to the lower end of the steering shaft 2 through a front axle, and a rear drive wheel 5 mounted on a rear drive axle 5c passing through support holes 12 formed in the rear end portion of the frame 1. A pair of gears 5a and 5b are disposed on the rear axle 5c on both the sides of the rear wheel 5, as shown in FIG. 10. The frame 1 comprises a pair of half cases 1a and 1b in which a windup spring unit 20 and two series of transmission gear mechanisms are disposed as shown in FIGS. 3–5. One transmission gear mechanism functions to transmit the driving force of the windup spring 22 to the rear wheel 5 through gear 5b secured to the rear axle 5c, while the other transmission gear mechanism functions to transmit windup force from the rear wheel 5 to the windup spring 22 via gear 5a secured to the rear axle 5c on the other side of the rear wheel 5. The half cases 1a and 1b are each provided with engaging projections 50a and 50b and engaging holes 51a and 51b, respectively, and the half cases 1a and 1b are coupled to each other by engaging the engaging projections 50a and 50b with the engaging holes 51a and 51b, as shown in FIG. 4. Further, the half cases 1a and 1b each are provided with hollows 52a and 52b having engaging projections 52c and 52d, respectively, and engaging hooks 53a and 53b, respectively, and the engaging hooks 53a and 53b engage with the engaging projections 52c and 52d to ensure the coupling of the half cases 1a and 1b when the half cases 1a and 1b are connected, as described above.

The steering shaft support 10 is composed of half support members 10a and 10b of the respective half cases 1a and 1b, and the bearing hole 11 is composed of half support bearings 11a and 11b of the respective half cases 1a and 1b, as shown in FIGS. 3 and 4.

Figure 13:
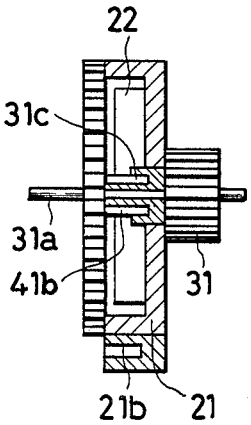
FIG. 13 is an enlarged fragmentary transverse cross sectional view of the windup spring drive unit of FIG. 5.
Figure 8:
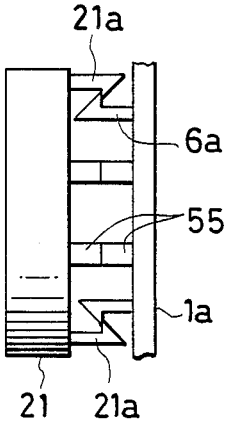
FIG. 8 is a side view of the box of FIG. 6, disposed to the half of the frame of FIG. 5.
Figure 11:
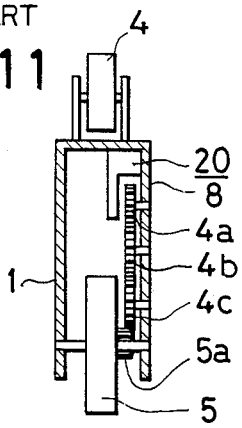
PRIOR ART FIG. 11
FIG. 11 is a transverse cross sectional view of a conventional two-wheel toy vehicle.

The windup spring unit 20 comprises a box 21 and a windup spring 22 contained in the box 21, as shown in FIG. 5 and FIG. 13. The box 21 is provided with engaging hooks 21a on its one side, and the half case 1a is provided with engaging hooks 6a on its inner surface. The box 21 is disposed to the half case 1a by engaging the engaging hooks 21a of the box 21 with the engaging hooks 6a of the half case 1a. The half case 1a and the box 21 each are provided with spacers 55 on their opposite surfaces in order to arrange the box 21 along the longitudinal plane of the frame 1, as shown in FIG. 8. The box 21 is provided with a bearing slot 21b in its peripheral projection 21c and a hole 21d in its center.

Figure 7:
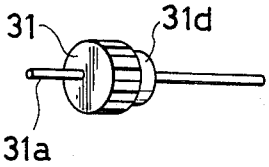
FIG. 7 is a perspective view of a first output gear fitted on a rotary shaft, as shown in FIG. 5.
Figure 14:
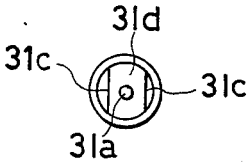
FIG. 14 is a left side view of FIG. 7.

The first transmission gear mechanism comprises an input gear 31, a first intermediate gear 32 and a first drive gear 33 engaging with the gear 5a mounted on the rear axle 5c, and these gears 31, 32 and 33 are consecutively engaged with one another. The input gear 31 is mounted on a drive shaft 31a and its opposite ends are fitted in bearing holes 6b and 7a formed in the respective half cases 1a and 1b, thereby rotatably and detachably mounting the input gear 31 onto the half cases 1a and 1b, as shown in FIG. 5a. As shown in FIG. 7, the input gear 31 is formed with a pair of hollows 31c in its boss portion 31d to be fitted into the central hole 21d of the box 21 of the windup spring unit 20. The first intermediate gear 32 is mounted on a shaft 32a which is detachably fitted in a slot 6c formed in the half case 1a so as to engage with the input gear 31, as shown in FIGS. 4 and 5. The first drive gear 33 having a bearing hole 33a in its center is rotatably mounted on a shaft 9 projecting from the half case 1a, so as to engage with the first intermediate gear 32 and the gear 5a mounted on the rear axle 5c. The shaft 9 is provided with a slit 9a in its free end portion in the longitudinal direction and end stoppers 9b on its free end for preventing the first drive gear 33 mounted on the shaft 9 from its falling off, as shown in FIG. 12. The slit 9a is so formed in the shaft 9 as to reduce the diameter of the free end portion of the shaft 9 by pressing the bifurcated flexible free end portion of the shaft 9 when the first drive gear 33 is fitted on the shaft 9 by passing the end stoppers 9b of the shaft 9 through the bearing hole 33a of the first drive gear 33. After fitting the first drive gear 33 on the shaft 9, the pressed bifurcated flexible free end is restored to its original shape so that the end stoppers 9b of the shaft 9 may prevent the first drive gear 33 from the falling off.

Figure 9:
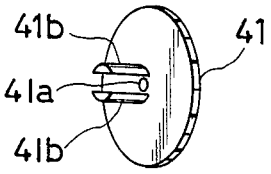
FIG. 9 is a perspective view of a second output gear shown in FIG. 5.

The second transmission gear mechanism comprises an output gear 41, a small gear 42b engaging with the output gear 41, a second intermediate gear 42 coaxially arranged with the small gear 42b, and a second drive gear 43 engaging with the second intermediate gear 42 and the gear 5b mounted on the rear axle 5c. The output gear 41 is provided with a bearing hole 41a in its center and a pair of projections 41b projecting from the central portion of its one side, as shown in FIG. 9. The output gear 41 is mounted to the input gear 31 by inserting the longer part of the shaft 31a into the central bearing hole 41a of the output gear 41 and engaging the projections 41b of the output gear 41 with the hollows 31c of the boss portion 31d of the input gear 31, as shown in FIG. 13. The second intermediate gear 42 is mounted on a shaft 42a of which opposite end portions are fitted in a slot 7b formed in the half case 1b and the bearing slot 21b of the box 21 of the windup spring unit 20, respectively, thereby rotatably mounting the second intermediate gear 42 onto the half case 1b and the box 21. The small gear 42b is secured on the shaft 42a coaxially with the second intermediate gear 42 so as to engage with the second output gear 41. The second drive gear 43 having a bearing hole in its center is rotatably mounted on a shaft 7c projecting from the half case 1b so as to engage with the second intermediate gear 42 and the gear 5b mounted on the rear axle 5c, as shown in FIG. 5a. The shaft 7c has the same structure as the shaft 9 on which the first drive gear 33 is rotatably mounted, and thus the second drive gear 43 mounted on the shaft 7c is prevented from its falling off by end stoppers formed on the free end of the shaft 7c.

Between the projections 41b of the output gear 41 is secured the inner end of the windup spring 22. Consequently, the driving force can be stored in the windup spring 22 by reversely rotating the rear wheel 5. That is, by reversely rotating the rear wheel 5, the windup spring 22 is wound up via the first transmission mechanism, i.e., the gear 5a mounted on rear axle 5c, the drive gear 33, the intermediate gear 32 and the input gear 31. Rotation of the rear wheel in reverse causes a commensurate rotation of output gear 41 which automatically induces intermediate gear 42 and small gear 42b to disengage from drive gear 43 as shaft 42a shifts within slots 6c and 21b. Then, when releasing the load from the rear wheel 5, the windup spring is released to output the stored energy via the second transmission mechanism, i.e., output gear 41, small gear 42b, intermediate gear 42, drive gear 43 and gear 5b mounted on rear axle 5c. This forward rotation causes commensurate rotation of intermediate gear 33 via gear 5a which induces intermediate gear 32 to disengage from input gear 31 as 32*a* shifts in its slot 6*c*.

Although the shafts 9 and 7*c* for the drive gears 33 and 43 are integrally secured to the inner surfaces of the half cases 1*a* and 1*b* of the frame 1, the other gears may be mounted to the frame 1 through shafts in the same manner as the shafts 9 and 7*c*.

In the first and the second transmission gear mechanism, the input gear 31 and output gear 41 are arranged between the spring box 21 and the respective half cases 1*a* and 1*b*. Further, although the spacers 55 are mounted on both the half case 1*a* and the box 21 in the above described embodiment, taken in conjunction with FIG. 8 the spacers having a proper length may be attached to either the half case 1*a* or the box 21.

According to the present invention, the following advantages are obtained.

Since at least one shaft for one of the gears of each series of transmission gear mechanism is integrally formed on the inner surface of the frame so as to prevent the one gear mounted on the one shaft from falling off, the two half cases 1*a* and 1*b* may be readily assembled without the gears falling off the shafts when attaching the windup spring unit and the transmission gear mechanisms to the frame, resulting in the assembly of the two-wheel toy vehicle being simplified and productivity being highly improved. Hence, the manufacturing cost may be significantly reduced.

Since the windup spring unit 20 comprising the box 21 and the windup spring 22 is arranged along the longitudinal plane of the frame and the two transmission gear mechanisms are arranged on both sides of the windup spring unit 20, the weight of left and right sides is well balanced and thus any unstableness due to lateral unbalance in the prior art is substantially removed. Further, since one or the other transmission gear mechanisms is always disengaged depending on the direction of rotation, the gear ratios can be different and can therefore be selected such that only a few rotations in reverse are required to fully wind the spring, while the fully wound spring can generate a significantly greater number of forward rotations.

Since the frame is composed of a pair of half cases, and the windup spring unit, the transmission gear mechanisms and the rear axle are arranged in the cases while the steering shaft support is integrally formed to the frame, the number of the components may be reduced and the structure of the toy vehicle may be simplified. Accordingly, the work efficiency on assembling may be largely improved and the strength of the toy vehicle may be increased. Thus, the production cost of the toy vehicle may be reduced.

Although the present invention has been described in its preferred embodiment with reference to the accompanying drawings, it is readily understood that various changes and modifications may be made without departing from the spirit and scope of the present invention.

What is claimed is:

1. A toy vehicle comprising:

a frame having a longitudinal plane therethrough;

a drive axle rotatably mounted on the frame, perpendicular to the longitudinal plane;

a drive wheel, affixed to the axle, disposed within the longitudinal plane;

a drive unit centrally disposed along the longitudinal plane;

a drive shaft extending through both sides of the drive unit perpendicular to the longitudinal plane and parallel to the drive axle;

a first gear mechanism disposed on one side of the longitudinal plane to transmit power from the drive to the drive axle;

a second gear mechanism disposed on the other side of the longitudinal, plane to transmit power from the drive axle to the drive; and a steered wheel rotatably affixed to the frame.

2. The invention of claim 1, wherein the frame comprises two half-cases and the gears of each gear mechanism are rotatably affixed to their respective half-case.

3. The invention of claim 2, wherein the drive unit is affixed to one half-case, spaced such that the center of gravity of the drive unit lies within the longitudinal plane of the frame.

4. The invention of claim 3, wherein the front portion of each half-case is provided with half of a support bearing such that when the two half-cases are joined, a complete support bearing is formed in which a steering shaft can be supported to which the steered wheel is rotatably affixed.

5. A two-wheeled toy vehicle comprising:

a frame having two half-cases coupled to one another along a longitudinal plane by engaging members formed on each half-case;

a drive axle rotatably mounted on the frame, perpendicular to the longitudinal plane;

a drive wheel, centrally affixed on the axle, disposed within the longitudinal plane;

a windup spring drive unit centrally disposed along the longitudinal plane, affixed to one half-case;

a drive shaft, extending through both sides of the drive unit, perpendicular to the longitudinal plane and parallel with the drive axle;

a first gear mechanism rotatably affixed to a half-case on one side of the longitudinal plane to transmit power from the output shaft to the drive axle;

a first movably mounted gear within the first gear mechanism that is automatically forced into engagement when the spring drive unit drives the drive shaft and automatically forced out of engagement when the drive axle is driven by an external force;

a second gear mechanism rotatably affixed to the other half-case on the other side of the longitudinal plane to transmit power from the drive axle to the drive shaft;

a second movably mounted gear within the second gear mechanism that is automatically forced into engagement when the drive axle is driven by an external force and automatically forced out of engagement when the spring drive unit drives the drive shaft;

a steering shaft rotatably attached to the frame coplanar with the longitudinal plane; and a steered wheel rotatably attached to the steering shaft perpendicular to its axis of rotation.

* * * * *